US009890032B2

(12) United States Patent
Carlsson

(10) Patent No.: US 9,890,032 B2
(45) Date of Patent: Feb. 13, 2018

(54) FUEL DISPENSER LOCKING ARRANGEMENT

(71) Applicants: NGC INNOVATION AB, Helsingborg (SE); Nils Gunnar Carlsson, Helsingborg (SE)

(72) Inventor: Nils Gunnar Carlsson, Helsingborg (SE)

(73) Assignees: NGC INNOVATION AB, Helsingborg (SE); Nils Gunnar Carlsson, Helsingborg (SE)

( * ) Notice: Subject to any disclaimer, the term of this patent is extended or adjusted under 35 U.S.C. 154(b) by 0 days.

(21) Appl. No.: 15/028,300

(22) PCT Filed: Sep. 24, 2014

(86) PCT No.: PCT/SE2014/000118

§ 371 (c)(1),
(2) Date: Apr. 8, 2016

(87) PCT Pub. No.: WO2015/053676

PCT Pub. Date: Apr. 16, 2015

(65) Prior Publication Data

US 2016/0244315 A1 Aug. 25, 2016

(30) Foreign Application Priority Data

Oct. 10, 2013 (SE) ..... 1330123

(51) Int. Cl.
*B65B 1/30* (2006.01)
*B67D 7/06* (2010.01)
(Continued)

(52) U.S. Cl.
CPC ..... *B67D 7/065* (2013.01); *B67D 7/04* (2013.01); *B67D 7/067* (2013.01); *B67D 7/425* (2013.01)

(58) Field of Classification Search
CPC ..... B67D 7/04; B67D 7/065; B67D 7/067; B67D 7/425
See application file for complete search history.

(56) References Cited

U.S. PATENT DOCUMENTS 4,354,536 A 10/1982 Moss
6,962,177 B1 11/2005 McCommons
(Continued)

FOREIGN PATENT DOCUMENTS

DE 3838980 A1 5/1990
DE 102005026433 A1 12/2006
(Continued)

OTHER PUBLICATIONS

International Search Report dated Feb. 12, 2015 for PCT Application No. PCT/SE2014/000118.
(Continued)

*Primary Examiner* — Jason K Niesz
(74) *Attorney, Agent, or Firm* — Moser Taboada

(57) ABSTRACT

The present invention provides a lockable fuel pump dispenser comprising a fuel outflow nozzle, locking means a transferring unit and a converter unit. The converter unit transferring a mechanical motion rendering a locking unit that is having locking means on the fuel outflow nozzle to fixate the fuel outflow nozzle securely inside a fuel tank of a vehicle. The converter unit comprises a battery, a solenoid or an electrical motor, a computer and a transmitter/receiver unit. The converter unit being able to wirelessly communicate with a unit operated from inside the station. The battery is being charged when the fuel pump handle is placed in the pump station.

9 Claims, 3 Drawing Sheets

(51) Int. Cl.
*B67D 7/42* (2010.01)
*B67D 7/04* (2010.01)

(56) References Cited

U.S. PATENT DOCUMENTS

| | | | | |
|---|---|---|---|---|
| 8,631,837 | B2 * | 1/2014 | Lauber | B67D 7/48<br>141/206 |
| 2003/0062380 | A1 | 4/2003 | Boyle et al. | |
| 2007/0034282 | A1 * | 2/2007 | Thorpe | B67D 7/42<br>141/206 |

FOREIGN PATENT DOCUMENTS

| | | | |
|---|---|---|---|
| EP | 0736484 | A2 | 10/1996 |
| EP | 0736484 | A3 | 10/1996 |
| WO | WO-02087969 | A1 | 11/2002 |
| WO | WO-03074416 | A1 | 9/2003 |

OTHER PUBLICATIONS

Extended European Search Report dated Apr. 21, 2017 for Application No. 14852594.2.

* cited by examiner

FUEL DISPENSER LOCKING ARRANGEMENT

FIELD OF THE INVENTION

The present invention relates to a locking arrangement in a fuel dispenser.

BACKGROUND OF THE INVENTION

The absolute majority of all vehicles in the world today are run on fluid fuel. Filling up the tank with today's fuel prices is rather costly. This has unfortunately lead to an increasing number of people simply not paying for the fuel and just running off once the tank is filled up.

In Sweden alone over 46 000 fuel thefts are committed every year costing the station owners more than 55 million Swedish SEK. Though fuel prices may be considered high for the customer, the actual earning per unit sold fuel is rather low. For every stolen full tank, it takes between 7-9 full fuelling to make up the loss for the theft. In many cases, the station owner also must pay taxes for the stolen fuel.

Seeing this increasing problem, numerous solutions have been tried out. The most common one is to prepay the fuel, either cash or by swiping a credit card. This may solve the fuel theft problem, but has the major drawback that the customer doesn't at any point have to go inside the station. If the customer doesn't have to enter the station to pay for the fuel, the chance of him going inside just to buy something else is decreasing severely. As the earnings on the fuel itself aren't particularly high, it is essential for any station owner also to sell other products, i.e. snacks, beverages, newspapers, etc.

Another way to try and solve the theft problem is to lock the nozzle to the vehicles tank as can be seen in U.S. Pat. No. 6,962,177. In this patent, retractable locking wedges comes out from the fuel nozzle spout and engaging under the fuel tanks restrictor area once the system is being pressurized by the fuel being pumped.

This system has a rather complicated structure with 3 sets of springs, sliding arms, rotating locks, diaphragm, locking sleeves, ratcheting members that should grip in the correct position and a ball for pushing said ratcheting member.

To unlock the wedges from the car, it is said that the station attendee should apply a momentary pressure with a penny's worth of gas on to the diaphragm. Not only does this mean that there is an increased risk of spilling the fuel, but also that the unlocking actually can be done by the person filling the tank himself.

Another drawback with such a complicated system, with several moving parts, is of course the increased risk for something malfunctioning. Such a complex system also has a high manufacturing and maintenance cost involved.

Another way to try to lock the nozzle to the vehicles tank may be seen in patent WO03074416. This mechanical solution involves a specialized pump, connections means for controlling said pump and a flexible elongated element, extending along the hose, between the pump unit and the specialized dispenser and nozzles. This elongated element is connected to a device at the end of the nozzle and this device is caused to take an active or deactivate position depending the elongated elements action. The elongated element is controlled by means associated with the pump and these means are being controlled, via a cable, from a cash desk or a checkout counter. A major drawback with this solution is that to be able to use such a system specialized pumps with control means, hoses with elongated elements, data transfer cables, specialized dispensers with nozzles all have to be installed at the pump station. Another drawback is that the elongated element is running along the hose which is constantly being pulled, twisted and turned. The rough handling increases the risk of a malfunctioning system which is leading to higher maintenance costs.

A system that allows a station attendee to control the release of the spout as well as a system that may be implemented to fueling stations without having to rebuild its entire set up and a system that is more cost efficient to produce and a system with a decreased risk for hazardous spills would therefore be of great benefit to the fueling industry.

SUMMARY OF THE INVENTION

The present invention provides a lockable fuel pump dispenser comprising a fuel pump handle, a fuel outflow nozzle, a locking unit with locking means, a transfer unit and a converter unit. The transfer unit being connected between the locking unit and the converter unit. The transfer unit is arranged for a mechanical motion by being moved in a predetermined direction, wherein the mechanical motion is being transferred by the converter unit. The converter unit comprises a solenoid or an electrical motor, and the mechanical motion from the transfer unit renders the locking unit and its locking means on the fuel outflow nozzle, to move and thereby fixate the fuel outflow nozzle securely inside a fuel tank of a vehicle. The converter unit further comprises a battery, a computer and transmitter/receiver unit.

The converter unit is defined as a unit that is being able to handle and control signals within the converter unit as well as to and from an external source. The external signals are defined as signals between the converter unit and an outside source i.e. a station cash desk and the internal signals are defined as signals within the converter unit, i.e. from the computer to the solenoid or electrical motor.

The internal signals may be converted by a solenoid or an electrical motor to a mechanical motion. The mechanical motion may be transferred via a transfer unit to a locking unit with locking means. The locking means may then be moved from a deactivated folded position to an activated unfolded position. Once the nozzle is placed inside a vehicle fuel tank and the locking means are in an activated position, the nozzle may not be removed until the locking means again are in its folded position. The receiver/transmitter are able to wirelessly communicate with the external source. The battery may be charged when the fuel pump handle is placed in the pump station.

One advantage is that the mechanical locking unit operates on a transfer unit directly connected between the locking means and the converter unit. The transfer unit may be constructed of e.g. a rod, bar or a wire. The transfer unit being connected to a locking mean that is adapted to extend from an unlocked position to an extended locked position upon interaction from the transfer unit. The locking means comprising at least one pivoted locking wing, but may comprise several pivoted locking wings.

One advantage with pivoted locking wings is that they may be constructed to, when in its folded position, not enlarge the spouts diameter. This making the locking means fit into the same vehicle fuel inlet openings as spouts without any locking means.

The locking wings may be placed at different places on the fuel outflow nozzle. If more than one wing is used, they may be placed at the same position around the fuel outflow nozzle or they may be placed at different places along the nozzles length. There may also be more than one set of wings or types of other locking means. One advantage with this is that the locking of the dispenser to the vehicle may be increased.

The computer unit and transmitter/receiver may send information wirelessly, i.e. via Bluetooth. When payment is completed, a signal may be sent from the station attendant to the locked dispenser, thereby releasing the locking mechanism from the vehicle.

The movable transfer unit that controls the locking means is placed inside a tube that is running along the fuel outflow nozzle, and is controlled by a solenoid or electrical motor, and is driven by a battery. The solenoid or electrical motor moves and locks the transfer unit and thereby the pushed out wings in a locked position until the computer unit receives a signal from the station attendant to release the rod, wire or bar and pull it back, thereby unlocking the wings.

One advantage with this is that only the station attendant is able to release the dispenser and also first after the payment for the fuel has been done. One advantage with this compared to prior solutions is that no "penny's worth of gas" has to be pumped to release the locking mechanism risking leakage and contamination. Not only is such a spill hazardous for the environment, but also a potential loss in revenue. Another advantage not having to use the pump for releasing the locking mechanism is that this constant short use of the pump inevitably wears on the pump mechanism. Also with this solution, the hose will be constantly set under pressure which not only increases the wear of gaskets, seals and o-rings, but increases the risk of contamination if any leakage should occur.

Once the signal from the attendant is given, the computer receives it and sends a signal to the solenoid or electrical motor to release and unlock the rod, bar or wire. The customer may then move the dispenser handle back to the fuel pump thereby putting the battery into its charge position. The battery is supplying the computer unit with power as well as power for driving the solenoid and transmitter/receiver. The battery may be charged via induction or via electrodes once placed into the fuel pump.

One great advantage with the inventions fuel pump dispenser system is that it may be in cooperated into existing stations without needs for any major rebuilding. The station may use its existing pumps and may use existing hoses. The only part that needs to be shifted is the pump handle. This along with a slight modification to the cash desk so that it is able to send and receive signals together with a small modification to the pump so the battery in the handle may be charged is the only thing that needs to be done for the system to work. No special pumps, complicated fuel dispensers, cables that needs to be drawn and hooked up or special hoses with complex elongated mechanical devices are needed with the inventions ingenious dispenser system.

Another great advantage with the system set up is that the station attendant does not have to judge whether the customer is reliable and allowed to pump the fuel. This automatization of course frees up valuable labor time for the attendant as well as it removes any possible risk for discrimination.

BRIEF DESCRIPTION OF THE DRAWINGS

FIG. 2 shows the transfer unit and the tube it runs through.

DETAILED DESCRIPTION

Figure 1:
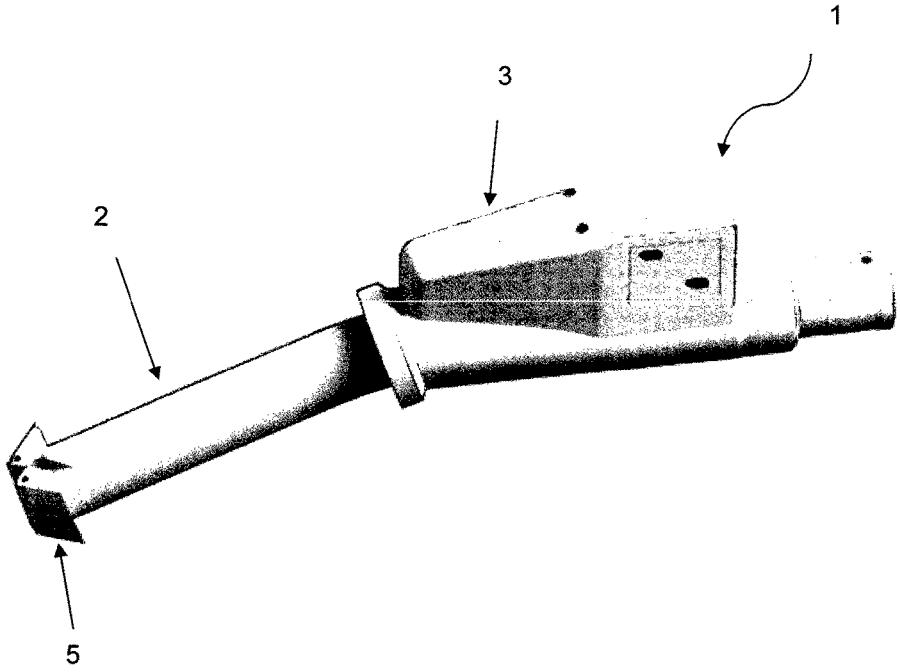
FIG. 1 shows a fuel pump dispenser with fuel outflow nozzle, converter unit and a locking unit with folded out locking means.
Figure 2:
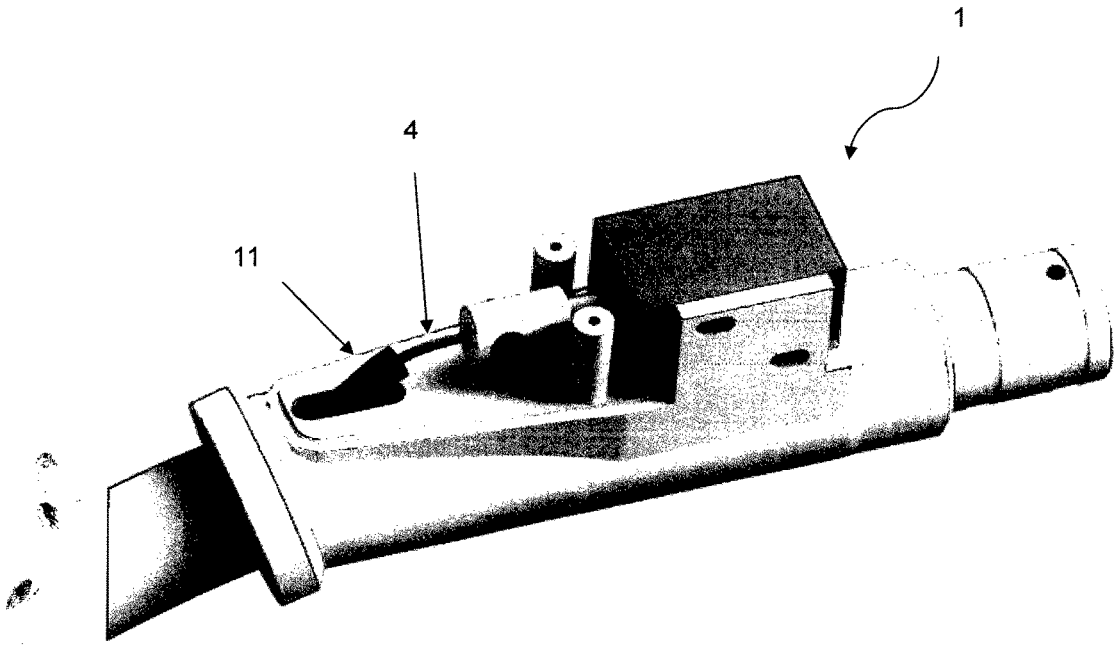
Figure 3:
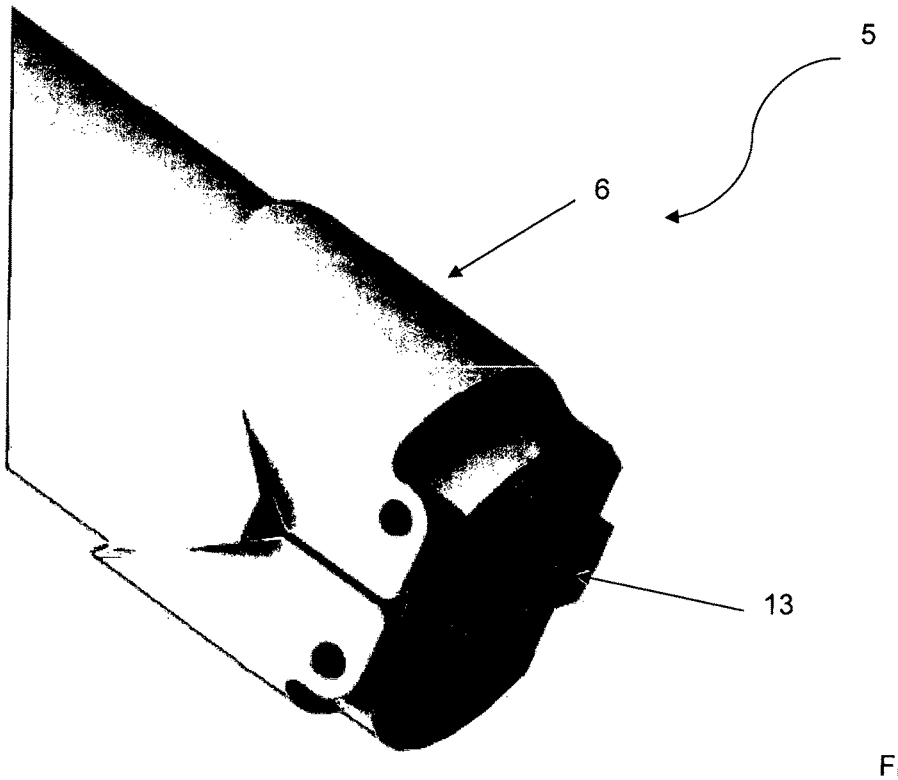
FIG. 3 shows a locking unit with folded in locking means.
Figure 4:
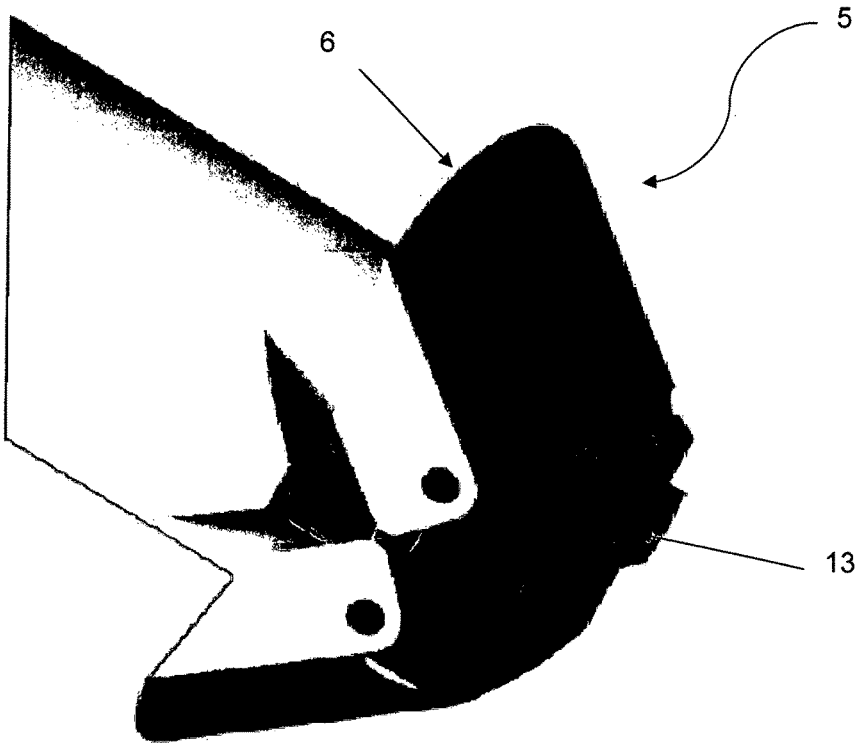
FIG. 4 shows a locking unit with folded out locking means.
Figure 5:
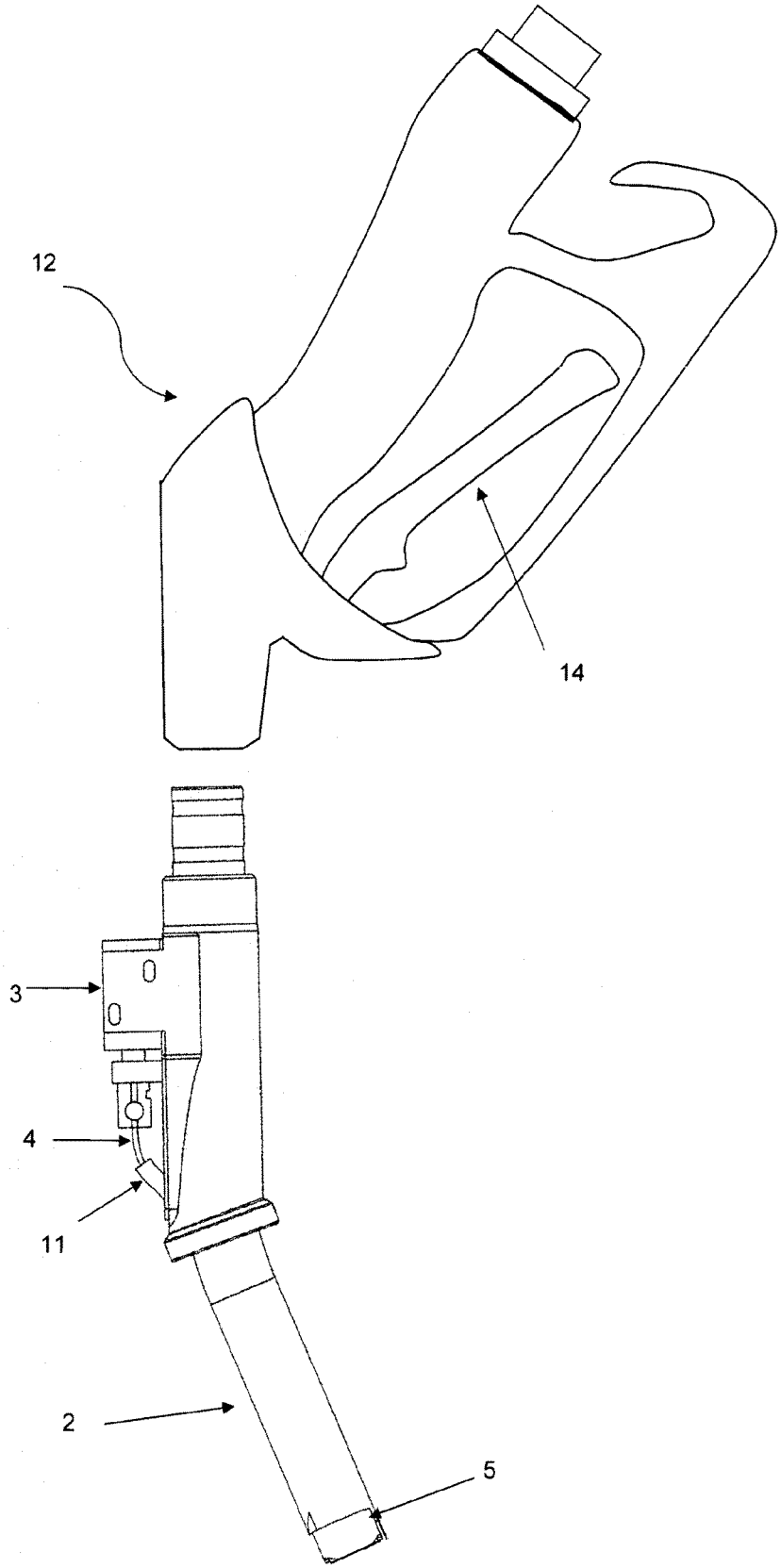
FIG. 5 shows a fuel pump dispenser with fuel outflow nozzle, locking unit, and an open view of the converter unit and a fuel pump handle.

The fuel pump dispenser 1 may be of different sizes. In one embodiment, it comprises a fuel outflow nozzle 2 and a converter unit 3. In one embodiment the converter unit 3 comprises a computer unit, a battery, a transmitter and receiver unit, and a solenoid. The converter unit 3 and fuel outflow nozzle 2 may in one embodiment be made up from more than one piece. In one embodiment the converter unit 3 is placed between the fuel outflow nozzle 2 and the fuel pump handle 12.

In one embodiment parts of the converter unit 3 is placed inside the fuel pump handle 12. The fuel pump handle 12 may in one embodiment house the battery and/or the computer unit, and/or the transmitter and receiver unit and/or the solenoid unit. In one embodiment the entire converter unit 3 is being housed inside the fuel pump handle 12.

In one embodiment the battery is being charged when the fuel pump handle 12 is placed in the fuel pump station. In one embodiment the battery is charged through induction and in one embodiment the battery may be charged through electrodes.

In one embodiment a locking unit 5 comprising a pair of pivoted wings is placed at the fuel outflow nozzle 2. The wings 6 are connected to a movable transfer unit 4. In one embodiment the transfer unit 4 comprises a slidable rod that may run freely in a tube 11. The tube 11 may in one embodiment be infused and run lengthwise in the outflow nozzle 2. The rod may in one end be connected to the locking mean 6 and in its other end be connected to a solenoid. The solenoid, when operating, may push and pull the rod 4 back and forth in the tube 11 thereby folding out and in the wings 6. In another embodiment the transfer units rod, wire or bar may be turned to fold out and in the wings 6.

In one embodiment the transfer unit 4 may be made of metal and in another embodiment the transfer unit 4 may be made of plastic or a composite material.

In one embodiment the locking means 6 is only one pivoted wing 6 and in another embodiment the locking means 6 comprises more than two pivoted wings 6. In one embodiment a plurality of wings 6 are placed at the same distance from the converter unit 3, in another embodiment a plurality of wings 6 are placed at different places along the fuel outflow nozzle 2. In one embodiment one set of wings 6 are placed in the end of the outflow nozzle 2 and a plurality of sets are placed along the outflow nozzle 2 closer to the converter unit 3.

In one embodiment, the locking mean 6 is connected to the fuel outflow nozzle 2 via a track that is letting the locking mean 6 slide from an unlocked position to a locked position. The locking mean 6 may in its unlocked position not enlarge the outflow nozzle 2 diameter.

The wings 6 may in one embodiment be constructed to, when folded in, not enlarge the outflow nozzle 2 diameter. In one embodiment the wings 6 may have the length in range of 10-40 mm. In another embodiment the wings 6 may have a length in the range of 10-20 mm. In another embodiment the wings 6 may have a length in the range of 10-80 mm.

In one embodiment the transfer unit 4 may be moved by a force created from the solenoid when it is being subject to a predetermined voltage from the battery. The created movement in the transfer unit 4 is then pushing the pivoted wings 6 outwards. The transfer unit 4 may be held in place, hence keep the wings 6 in outward position until the voltage in the solenoid is turned off.

In one embodiment the transfer unit 4 may be connected to at least one spring. The spring moving the transfer unit 4 back into its resting state and thereby the pivoted wings 6 to its folded position once the voltage in the solenoid is turned off. The force created by the solenoid, when subject to a voltage, may be greater than the force in the opposite direction created by the spring.

In one embodiment the converter unit 3 is equipped with a transmitter/receiver unit for wireless communication. In one embodiment such communication may be carried out via e.g. Bluetooth technology. The transmitter/receiver may in one embodiment communicate with a computer and the transmitter/receiver may be controlled by the station attendant.

In one embodiment, the converter system is activated when the user is pushing the lever 14 on the fuel pump handle 12. A signal is sent from the lever 14 being pushed and the signal is received by the computer unit, which then sends a signal to activate the solenoid and also a signal via the transmitter/receiver to the station cash desk computer. The activated solenoid pushes the transfer unit 4, in its predetermined direction, thereby folding out the pivoted wings to its active position. The unfolded wings lock the fuel outflow nozzle 2 to the vehicles fuel tank. Once the wings are fully folded out, a signal may be wirelessly sent from the converter units 3 transmitter/receiver to the station cash desk computer, which then may start the pump.

In one embodiment the solenoid is turned off by the station attendant sending a signal to the converter unit 3. In one embodiment the signal may be automatically sent from the cash desk computer to the converter unit 3 as soon as payment has been done without having the station attendant manually sending the signal. Once the signal is received the computer unit adjusts the voltage sent to the solenoid and thereby releasing the transfer unit 4. In one embodiment a spring moves the transfer unit 4 back into its starting position, thereby folding the wings 6 and releasing the grip of fuel outflow nozzle 2 from the vehicle tank. The customer may then pull out the fuel outflow nozzle 2 and place it back into the fuel pump station.

In one embodiment the locking means 6 may be constructed from a rubber bushing that may swell when force is applied upon it. The rubber bushing when no force is applied on it, is in its rested state and has the same outer diameter as the outflow nozzle 2. In another embodiment the locking means 6 may be constructed from a split bushing. The split bushing may be made from metal and may enlarge when force is applied upon it. The split bushing when no force is applied on it, is in its rested state and has the same outer diameter as the outflow nozzle 2.

In one embodiment the outflow nozzle 2 has a round or oval outer shape and in another embodiment the outflow nozzle 2 has a squared outer shape. In one embodiment the outflow nozzle 2 has a splash sensor 13, preventing from overfilling the fuel tank. In one embodiment the fuel outflow nozzle 2 may have an outer diameter between 15-25 mm. In one embodiment the fuel outflow nozzle 2 may have an outer diameter between 18-20 mm.

The present invention is also directed to a fuel outflow nozzle 2 comprising a locking unit 5 with locking means 6 in the form of at least one pivoted wing.

In one embodiment, the locking unit 5 may comprise several locking means 6, wherein each locking means 6 has a length in the range of 10-40 mm. In another embodiment the wings 6 may have a length in the range of 10-80 mm.

The invention claimed is:

1. Fuel pump dispenser, said fuel pump dispenser comprising:

a fuel outflow nozzle;

a converter unit;

a fuel pump handle;

a transfer unit; and a locking unit, said transfer unit being connected between said locking unit and said converter unit, wherein said transfer unit is arranged for a mechanical motion by being moved in a predetermined direction, wherein said mechanical motion is being transferred by said converter unit, wherein said converter unit comprises a solenoid or an electrical motor, wherein said motion is rendering said locking unit having locking means on the fuel outflow nozzle, to move and thereby fixate the fuel outflow nozzle securely inside a fuel tank of a vehicle, and wherein said converter unit further comprises a transmitter/receiver unit for communicating and, wherein said communication to and from said transmitter/receiver unit is wireless, and wherein the locking means is at least two pivotable locking wings, which pivotable locking wings, when being in a locked position, are in direct contact against a fuel inlet of a vehicle.

2. Fuel pump dispenser according to claim 1, wherein the locking unit comprises several locking means.

3. Fuel pump dispenser according to claim 1, wherein the fuel pump dispenser also comprises a computer unit.

4. Fuel pump dispenser according to any claim 1, wherein the transfer unit comprises a bar, rod or wire.

5. Fuel pump dispenser according to claim 1, wherein each locking means has a length in the range of 10-40 mm.

6. Fuel pump dispenser according to claim 1, wherein said converter unit comprises a battery.

7. Fuel pump dispenser according to claim 1, wherein the fuel pump dispenser comprises a battery and charging of the battery is done via induction.

8. Fuel pump dispenser according to claim 1, wherein the fuel pump dispenser comprises a battery and charging of the battery is done via electrodes.

9. Fuel pump dispenser according to claim 7, wherein the battery is charged when the fuel pump handle is positioned in a pump station.

* * * * *